US006915773B2

(12) United States Patent
Smith

(10) Patent No.: US 6,915,773 B2
(45) Date of Patent: Jul. 12, 2005

(54) LAWN MOWER WITH POWER-ASSISTED STARTER

(76) Inventor: Charles K. Smith, 216 Spruce Hollow Rd., Northumberland, PA (US) 17857

( * ) Notice: Subject to any disclaimer, the term of this patent is extended or adjusted under 35 U.S.C. 154(b) by 73 days.

(21) Appl. No.: 10/457,290

(22) Filed: Jun. 9, 2003

(65) Prior Publication Data

US 2004/0244754 A1 Dec. 9, 2004

(51) Int. Cl.[7] ..... F02N 11/00
(52) U.S. Cl. ..... 123/179.26; 56/10.5
(58) Field of Search ..... 123/179.24, 179.26; 56/10.5

(56) References Cited

U.S. PATENT DOCUMENTS 3,084,679 A * 4/1963 Brown et al. ..... 123/185.15
5,133,312 A * 7/1992 Schede ..... 56/10.5

* cited by examiner

*Primary Examiner*—Andrew M. Dolinar
(74) *Attorney, Agent, or Firm*—William H. Eilberg

(57) ABSTRACT

A gasoline-fueled lawn mower has a pull rope that extends from the lawn mower engine and is attached to a pulley. An electrically powered starter motor is brought into engagement with the pulley, so that actuation of the starter motor causes the rope to be drawn out of the lawn mower engine, so as to start the engine. When the engine starts, the starter motor is disengaged, allowing the pull rope to be at least partly retracted into the engine. The pulley and the starter motor are preferably mounted on cross bars extending between portions of the lawn mower handle, the starter motor being mounted so as to slide along the cross bars. The invention also includes a kit for modifying a lawn mower to include a power-assisted starting mechanism.

11 Claims, 3 Drawing Sheets

LAWN MOWER WITH POWER-ASSISTED STARTER

BACKGROUND OF THE INVENTION

The present invention relates to the field of lawn mowers and the like, and provides a power-assist mechanism that makes it easy to start the engine of a lawn mower.

Conventional lawn mowers are powered either by electric motors or by gasoline-fueled internal combustion engines. Electric-powered lawn mowers have not been entirely satisfactory, because they require either a long and unwieldy cord that must be plugged into an electrical outlet while the mower is in use, or, if they can operate without a power cord, their batteries must be frequently recharged. By contrast, gasoline-fueled lawn mowers are self-contained, use relatively small amounts of fuel, and produce relatively large amounts of power for extended periods of time.

The major inconvenience of a gasoline-fueled lawn mower arises in starting the engine. Due to the inherent properties of an internal combustion engine, the engine cannot be started unless it is already turning, so that the cylinder(s) and valve(s) are in motion. The conventional starting mechanism on a mower of the prior art includes a pull rope, which is connected to the crankshaft of the engine, and which is manually pulled to start the engine. The rope is typically provided with a retraction mechanism so that after it is pulled out, it will become automatically rewound onto a suitable storage device inside the lawn mower housing.

In practice, a pull rope is inconvenient to use. Many lawn mower motors have only one cylinder and one spark plug, and if the engine is not tuned optimally, the engine may not start on the first try. Indeed, several attempts to start the engine are often required, before the engine finally starts. With a pull rope, it is necessary to exert considerable force to pull the rope out swiftly but smoothly, and this operation becomes especially inconvenient when it must be repeated several times. The difficulty of starting a lawn mower may make it unfeasible for the mower to be used by an elderly or weak person, and may even deter an able-bodied person from using a gasoline-fueled lawn mower.

The present invention solves the above-described problem by providing a gasoline-fueled lawn mower having a power-assisted starting mechanism. The starting mechanism may be provided as a kit for attachment to an existing lawn mower, thereby making a conventional lawn mower much easier to start.

SUMMARY OF THE INVENTION

The present invention comprises a lawn mower having a power-assisted starting mechanism. The lawn mower engine is attached to a pull rope, and the pull rope is wound onto a pulley. A starter motor, which can be an electric drill, is releasably engageable with the pulley, such that the starter motor, when so engaged, turns the pulley rapidly so as to wind the pull rope onto the pulley. The act of winding the pull rope draws the rope out of the engine, thereby causing the engine to start.

In the preferred embodiment, the pulley is mounted to a pair of cross bars that extend between portions of the handle of the lawn mower. The starter motor is also mounted to the cross bars, and is capable of sliding along the cross bars.

The invention also includes a kit for attachment to a conventional gasoline-fueled lawn mower. The kit includes at least one cross bar, means for attaching the cross bar to the lawn mower handle, a pulley, means for affixing the pulley to the cross bar, and a starter motor, with means for slidably attaching the starter motor to the cross bar. Installation of the above-described kit greatly simplifies the process of starting the lawn mower.

The present invention also includes the method of operating a lawn mower, comprising moving a starter motor into engagement with a pulley that is connected to a pull rope extending from the lawn mower engine. The starter motor is actuated, causing the pulley to turn, and thereby pulling the rope out of the engine, causing the engine to start. These steps may be repeated if the engine does not start on the first attempt. When the engine starts, the starter motor is disengaged from the pulley, allowing the pull rope to be at least partly retracted into the engine housing.

The present invention therefore has the primary object of providing a lawn mower having a power-assisted starting mechanism.

The invention has the further object of making it easy to start a gasoline-fueled lawn mower.

The invention has the further object of providing a lawn mower having a starter that can comprise an electric drill or other simple electric motor.

The invention has the further object of enabling a gasoline-fueled lawn mower to be used by those who would otherwise be deterred by the difficulty of starting such mower.

The invention has the further object of providing a kit for attachment to a conventional gasoline-fueled lawn mower, the kit providing power-assisted means for starting the mower.

The invention has the further object of providing a power-assisted method of starting a gasoline-fueled lawn mower.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
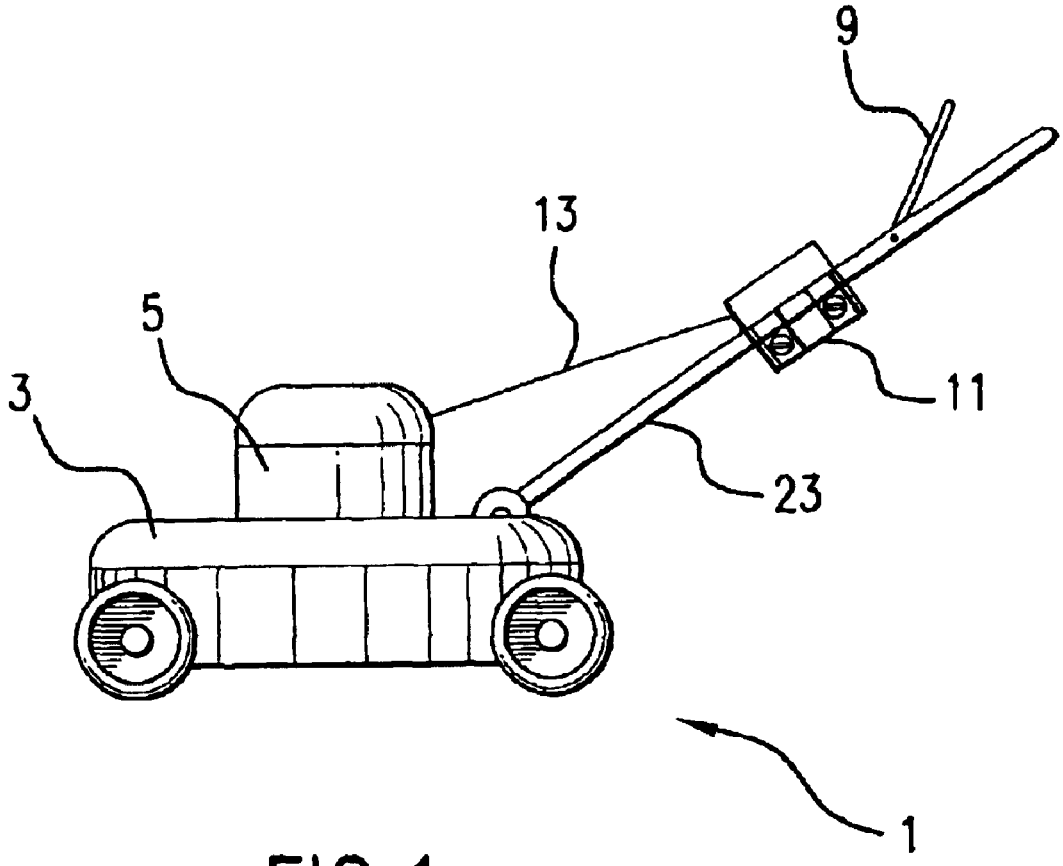
FIG. 1 provides a side elevational view of a lawn mower having the power-assisted starting mechanism of the present invention.

FIG. 1 shows a lawn mower 1 which incorporates the present invention. The lawn mower includes conventional housing 3 which supports engine 5. The internal structure of the engine is conventional, and forms no part of the present invention. The engine is connected to rotate a cutting blade (not shown) which is also conventional. The handle of the lawn mower includes two generally parallel, spaced-apart bars, only one of which is visible in the side elevational view of FIG. 1, the visible handle portion being designated by reference numeral 23. The upper end of the handle includes safety bar 9, which must be depressed before the engine will start. The safety bar is also conventional, and is not part of the present invention.

A power-assist mechanism 11, made according to the present invention, is mounted to the handle, in a manner to be explained in more detail below. Pull rope 13 extends from engine 5, and is wound on a pulley within the power-assist mechanism 11. Pulling the pull rope out of the engine causes the engine to start. A retraction device (not shown) located inside the engine housing, draws the pull rope back into the engine housing when the rope is released. The pull rope and retraction device, and their connection to the interior of the engine, are entirely conventional.

Figure 2:
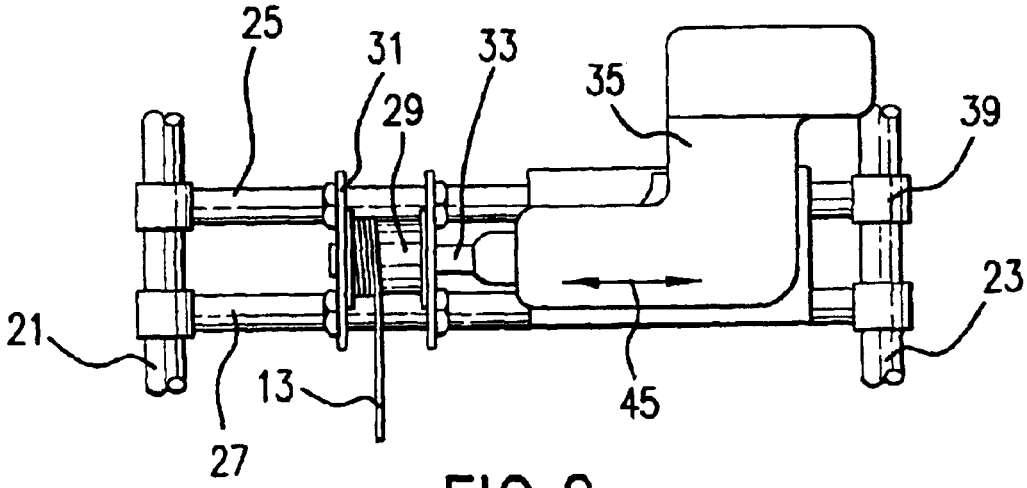
FIG. 2 provides a top view of a portion of the handle of the lawn mower of the present invention, showing the power-assisted starting mechanism of the present invention, including a starting motor engaged with a pulley onto which a pull rope is wound.
Figure 3:
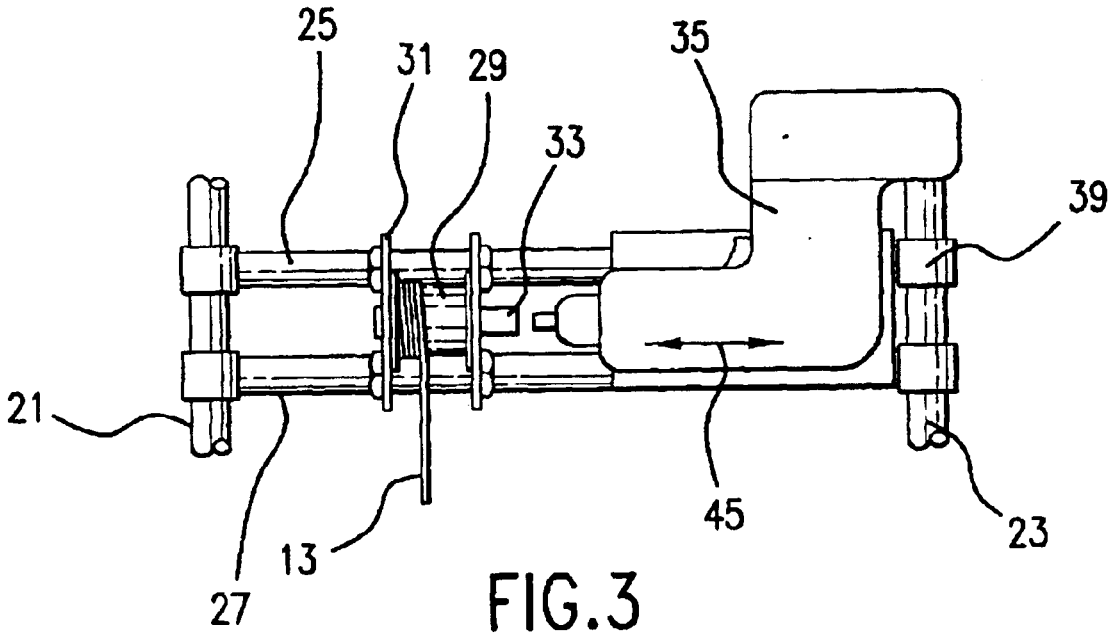
FIG. 3 provides a view similar to that of FIG. 2, but in which the starting motor has been disengaged from the pulley.

FIGS. 2 and 3 show more details of the power-assist mechanism of the present invention. Both FIGS. 2 and 3 show fragments of the left-hand and right-hand portions 21 and 23 of the lawn mower handle, only one of which, namely right-hand portion 23, was shown in FIG. 1. Cross bars 25 and 27 extend between the left-hand and right-hand handle portions 21 and 23, and are affixed to the handle portions by any suitable means. Such means may include a frictional grip, such as clamps 39 that are attached to the handle portions. One could alternatively use threaded engagement, or some other means of affixation, or any combination of the above.

Pulley 29 is mounted on cross bars 25 and 27. The pulley includes a stationary frame 31 which is preferably attached to the cross bars such that it cannot move relative to the cross bars. The pulley also includes a rotatable drum, onto which the pull rope 13 is wound, as shown in the figures. The drum is connected to engagement coupler 33. Rotation of the coupler causes rotation of the drum, causing the pull rope to be wound or unwound.

Also mounted on the cross bars is starter motor 35. The starter motor may simply be an electric drill which is battery operated, and which has its own internal clutch (not shown). Alternatively, the starter motor may be any other compact motor, preferably electrically powered, which can be conveniently mounted on the cross bars. One advantage of using an electric drill is that it is a readily available component which can be incorporated easily into the present invention.

Figure 4:
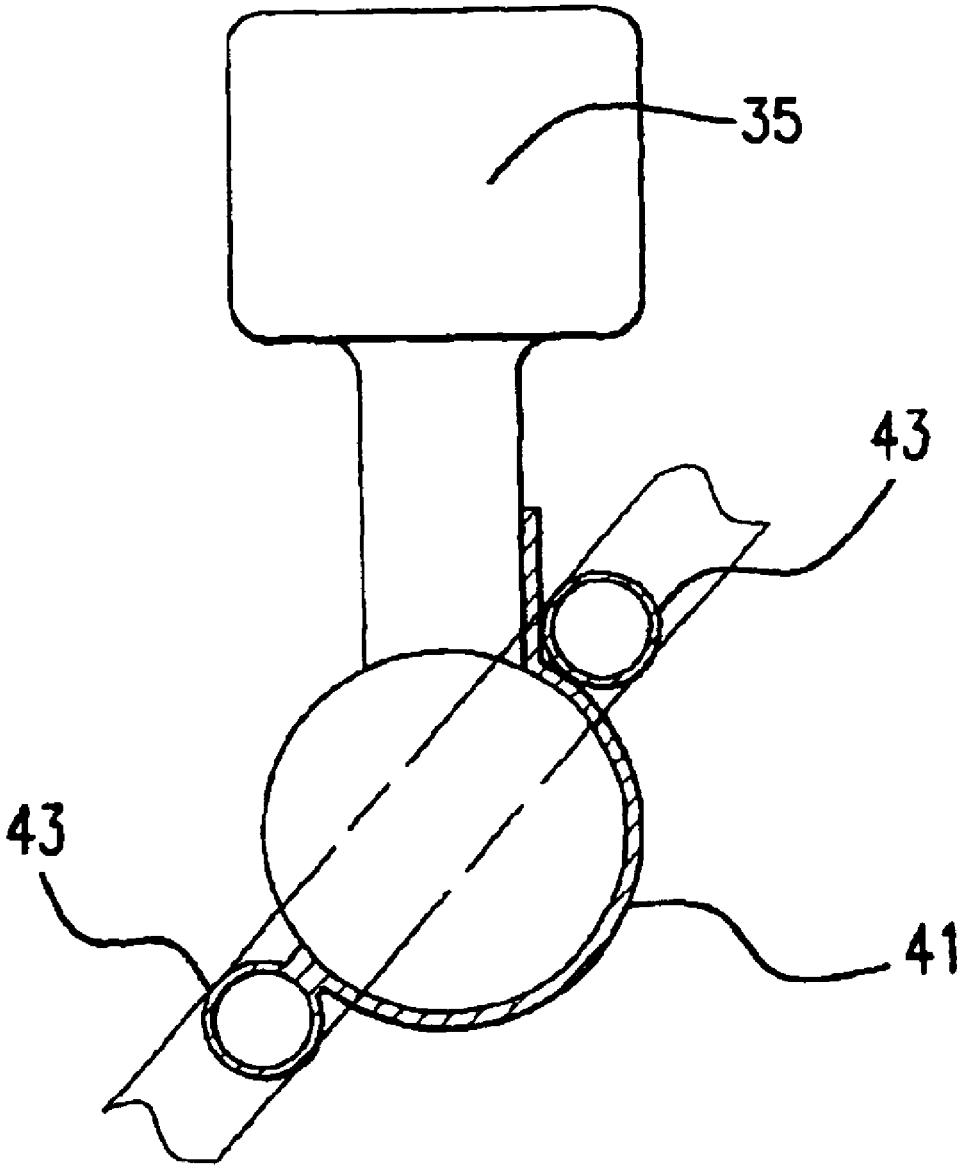
FIG. 4 provides an end view of the starting motor used in the present invention, showing more detail of its connection to the handle of the lawn mower.

The end view of FIG. 4 shows further details of the mounting of the starter motor to the cross bars. The starter motor is attached to bracket 41 that includes sleeves that engage the cross bars, and that allow the starter motor to slide laterally along the cross bars, as indicated by arrows 45. FIG. 2 shows the starter motor in a position wherein it is engaged with the coupler of the pulley, and FIG. 3 shows the starter motor in the disengaged position. Note that, in FIG. 3, the starter motor is displaced further to the right, as compared with its position in FIG. 2.

The present invention operates in the following manner. When it is desired to start the lawn mower engine, one slides the starter motor towards the pulley. One must turn the pulley drum until the coupler engages with the starter motor, as shown in FIG. 2.

Next, one holds down the safety bar 9, and actuates the starter motor. Being engaged with the pulley drum, the motor causes the pull rope to be wound rapidly onto the pulley. If the engine starts, one simply slides the starter motor into a disengaged position, thereby allowing the retraction device (not shown), located inside the engine housing, to pull the rope back and rewind it.

If the engine does not start, one can slide the starter motor into the disengaged position, allowing the pull rope to be rewound into the engine housing. One can then try again, by sliding the starter motor into engagement with the pulley, and actuating the starter motor to pull the rope out again. The end of the pull rope is preferably fastened permanently to the pulley, so that the end portion of the rope is never fully retracted into the engine housing, but instead is held by the pulley. Thus, the pull rope is always ready to be pulled out when the starter motor is engaged with the pulley. The process is repeated as necessary, until the engine starts.

If the invention is used with a lawn mower that does not have a safety bar, then the step of holding down the safety bar is omitted, without affecting the operation of the method.

Having the pull rope affixed to the pulley means that the engine must be started during a movement of the pull rope that corresponds to less than its full length. But the power-assist feature of the present invention amply compensates for the fact that the full length of the pull rope is not usable.

Although the preferred form of starter motor is an electric drill, having its own built-in clutch, it is understood that the invention can be practiced with other forms of starter motors. It is possible to provide a clutch within the pulley mechanism itself, if the starter motor does not have its own clutch. While it is preferred that the starter be electrically powered, the invention can be practiced with any other form of starter motor. What is important is that the starter motor be sufficiently compact that it can be conveniently mounted on the cross bars for engagement with the pulley.

The present invention can be provided as a kit for modifying a conventional lawn mower to include the features of the invention. Such kit may include a pair of cross bars with suitable means for attaching them to the handle portions of the lawn mower, a pulley, a starter motor (which could be an electric drill), and a bracket for mounting the starter motor to the cross bars. The kit could be provided with fewer than all of the above components. For example, the kit may include all of the components except the drill, in which case the user would be expected to supply the drill or equivalent motor.

The dimensions of the components of the kit can be provided so as to accommodate lawn mowers of various sizes. The kit can be made to work with virtually any conventional lawn mower that has two generally parallel handle portions, onto which the cross bars can be mounted, and a pull rope.

The starter motor can be kept permanently on the lawn mower, and thus used exclusively to start the mower, or it can be removed and used and/or stored elsewhere.

The invention can be modified in various ways. The exact manner of mounting the cross bars, the pulley, and the starter motor can be changed. The invention can be used with lawn mowers having a safety bar, or with older models that do not have this safety feature. With redesign of some components, it may be possible to have one cross bar instead of two. These and other modifications, which will be apparent to those skilled in the art, should be considered within the spirit and scope of the following claims.

What is claimed is:

1. A lawn mower with a power-assisted starting mechanism, comprising:

a) a housing supporting a mower engine, the engine being attached to a pull rope, b) the pull rope being wound on a pulley, and c) a starter motor, the starter motor being releasably engageable with the pulley so that the starter motor, when engaged with the pulley, is capable of turning the pulley so as to wind the pull rope onto the pulley so as to start the engine, wherein the housing is connected to a handle which includes two generally parallel portions, and wherein there is at least one cross bar connected between said portions of the handle, and wherein the pulley is mounted on said cross bar.

2. The lawn mower of claim 1, wherein the starter motor is slidably mounted on said cross bar.

3. A lawn mower with a power-assisted starting mechanism, comprising:

a) a housing supporting a mower engine, the engine being attached to a pull rope, the housing being connected to a handle having two generally parallel portions, b) the pull rope being wound on a pulley, the pulley being attached to a pair of cross bars extending between said portions of said handle, and c) a starter motor, the starting motor being slidably mounted on said cross bars and being releasably engageable with the pulley so that the starter motor, when engaged with the pulley, is capable of turning the pulley so as to wind the pull rope onto the pulley so as to start the engine.

4. In a lawn mower including a housing, an engine supported by the housing, and a pull rope connected to the engine, the improvement comprising:

a) a pulley onto which the pull rope is wound, and b) a starter motor, the starting motor being releasably engageable with the pulley so that the starter motor, when engaged with the pulley, is capable of turning the pulley so as to wind the pull rope onto the pulley so as to start the engine, wherein the housing is connected to a handle which includes two generally parallel portions, and wherein there is at least one cross bar connected between said portions of the handle, and wherein the pulley is mounted on said cross bar.

5. The improvement of claim 4, further comprising means for mounting the starter motor in a vicinity of the pulley.

6. The improvement of claim 5, wherein the mounting means comprises means for permitting the starter motor to slide into and out of engagement with the pulley.

7. The improvement of claim 4, wherein the starter motor is slidably mounted on said cross bar.

8. A kit for attachment to a lawn mower which includes an engine, a handle having two generally parallel portions, and a pull rope, the kit comprising:

a) at least one cross bar, the cross bar being sized to extend between said parallel portions of the lawn mower handle, b) means for attachment of the cross bar to said portions of the handle, c) a pulley, and means for affixing the pulley to the cross bar, d) a starter motor, and means for slidably attaching the starter motor to the cross bar.

9. The kit of claim 8, wherein there are two cross bars, and wherein the attachment means comprises a clamp adapted for engagement with one of said parallel portions.

10. The kit of claim 9, wherein the starter motor comprises an electric drill.

11. A lawn mower with a power-assisted starting mechanism, comprising:

a) a housing supporting a mower engine, the engine being attached to a pull rope, b) the pull rope being wound on a pulley, and c) an electrically operated starter motor, the starter motor being independent of the mower engine, the starter motor being releasably engageable with the pulley so that the starter motor, when engaged with the pulley, is capable of turning the pulley so as to wind the pull rope onto the pulley so as to start the engine.

* * * * *